US007641198B2

(12) United States Patent
Ko et al.

(10) Patent No.: US 7,641,198 B2
(45) Date of Patent: Jan. 5, 2010

(54) METHOD FOR ADDING QUALIFIER TO CASINO GAMES

(75) Inventors: Bernard Chung Bon Ko, Foster City, CA (US); Thomas Artle, Incline Village, NV (US)

(73) Assignee: TAJA Enterprises, LLC, Livermore, CA (US)

( * ) Notice: Subject to any disclaimer, the term of this patent is extended or adjusted under 35 U.S.C. 154(b) by 377 days.

(21) Appl. No.: 11/697,029

(22) Filed: Apr. 5, 2007

(65) Prior Publication Data

US 2007/0241507 A1 Oct. 18, 2007

Related U.S. Application Data

(63) Continuation-in-part of application No. 11/254,563, filed on Oct. 19, 2005, now abandoned, which is a continuation-in-part of application No. 10/947,188, filed on Sep. 21, 2004, now Pat. No. 7,487,970.

(51) Int. Cl.
*A63F 1/00* (2006.01)

(52) U.S. Cl. ..... 273/292; 273/274

(58) Field of Classification Search ..... 273/292, 273/309, 274; 463/13, 12
See application file for complete search history.

(56) References Cited

U.S. PATENT DOCUMENTS 5,226,661 A 7/1993 Wolf
5,248,142 A 9/1993 Breeding
5,275,416 A * 1/1994 Schorr et al. ..... 273/292
5,314,194 A 5/1994 Wolf
5,397,128 A 3/1995 Hesse et al.
5,503,401 A 4/1996 Nguyen
5,529,309 A 6/1996 Bartlett
5,540,444 A 7/1996 Nguyen
5,560,613 A 10/1996 Nguyen
5,584,486 A 12/1996 Franklin
5,607,161 A 3/1997 Skratulia
5,645,281 A 7/1997 Hesse et al.
5,685,774 A 11/1997 Webb
5,725,216 A 3/1998 Jones
5,803,460 A 9/1998 Hesse
5,863,041 A 1/1999 Boylan et al.

(Continued)

OTHER PUBLICATIONS

Co-pending U.S. Appl. No. 10/947,188, filed Sep. 21, 2004 entitled "Pai-Gow Poker Game".

(Continued)

*Primary Examiner*—Benjamin H Layno
(74) *Attorney, Agent, or Firm*—Lewis and Roca LLP

(57) ABSTRACT

An improvement to two groups of wagering games with at least one player hand and a dealer hand. In one group, the gaming pieces in a hand are divided into two or more sub-hands. In the other group the games include a Reverse Bet and/or a Push Bet. Games may be in both groups. In the improved versions of these games, at least one type of wager has a minimum hand value, known as a qualifier. When a pre-specified hand has that hand value or higher, one method of settling wagers is used. Otherwise, a different method is used for settling at least one type of wager. Introducing this qualifier allows a casino to adjust the advantage for the dealer, making several desirable options practical for these games.

57 Claims, 2 Drawing Sheets

U.S. PATENT DOCUMENTS

Figure 1:
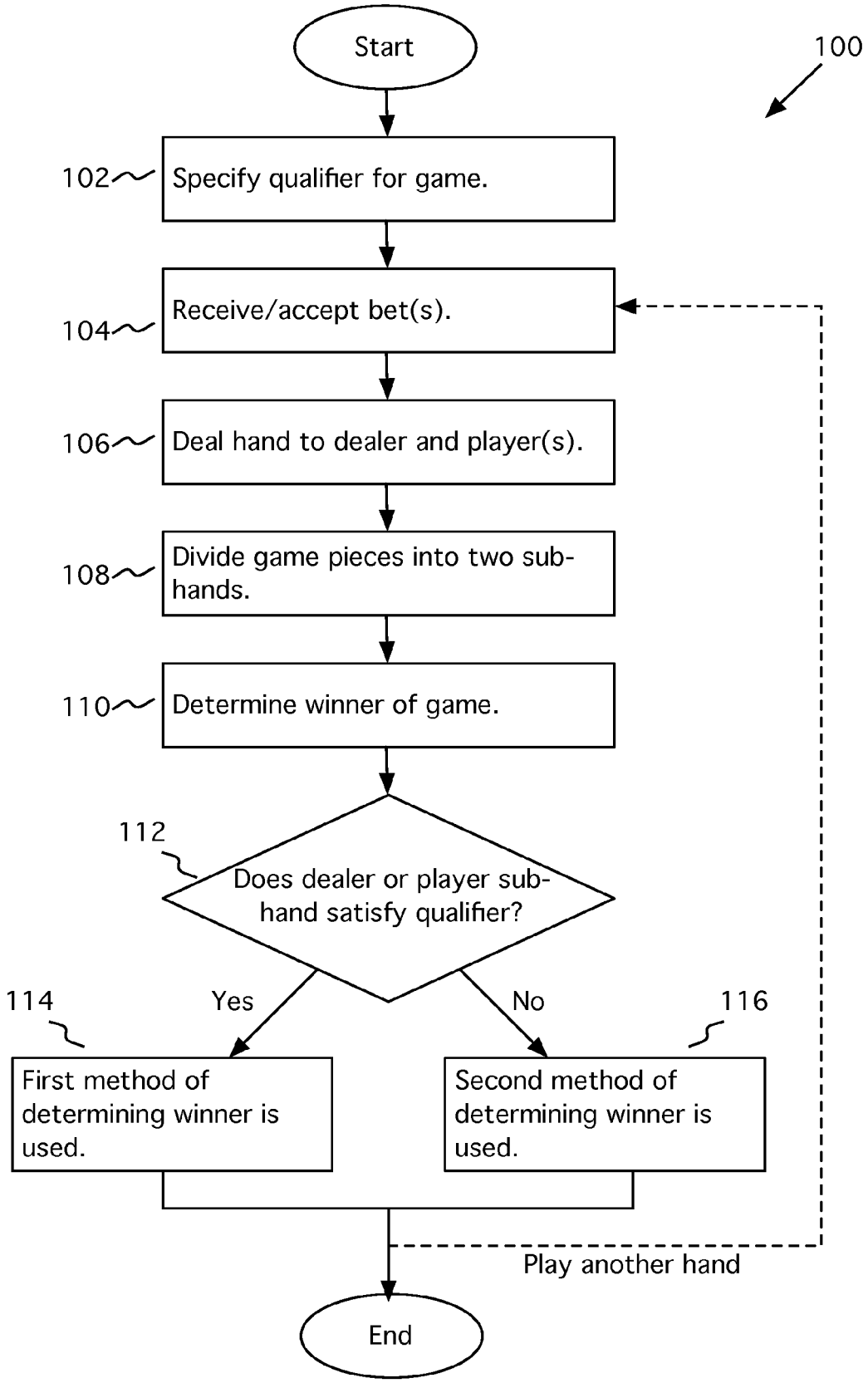

| | | | | |
|---|---|---|---|---|
| 6,007,424 | A | 12/1999 | Evers et al. | |
| 6,012,720 | A | 1/2000 | Webb | |
| 6,050,569 | A | 4/2000 | Taylor | |
| 6,070,876 | A | 6/2000 | Ko | |
| 6,105,964 | A | 8/2000 | Maahs | |
| 6,135,453 | A | 10/2000 | Srichayaporn | |
| 6,135,454 | A | 10/2000 | Mostashari | |
| 6,270,078 | B1 | 8/2001 | Leone et al. | |
| 6,332,614 | B1 | 12/2001 | Hesse | |
| 6,394,456 | B1 | 5/2002 | Long | |
| 6,402,147 | B1 | 6/2002 | Lo | |
| 6,409,174 | B1 | 6/2002 | Demarest | |
| 6,474,646 | B1 | 11/2002 | Webb | |
| 6,481,717 | B1 | 11/2002 | Richardelle | |
| 6,491,302 | B1 | 12/2002 | Boylan et al. | |
| 6,503,145 | B1 | 1/2003 | Webb | |
| 6,511,071 | B1 | 1/2003 | Artle et al. | |
| 6,575,464 | B1 * | 6/2003 | Fertitta et al. | 273/274 |
| 6,719,291 | B1 | 4/2004 | deKeller | |
| 6,811,153 | B1 | 11/2004 | Ko | |
| 6,840,517 | B2 | 1/2005 | Snow et al. | |
| 7,044,468 | B2 | 5/2006 | Sklansky et al. | |
| 7,070,505 | B2 | 7/2006 | Vancura et al. | |
| 7,147,227 | B2 | 12/2006 | Taghavi | |
| 7,195,244 | B1 | 3/2007 | Feola | |
| 7,487,970 | B1 | 2/2009 | Ko | |
| 2005/0029742 | A1 | 2/2005 | Snow | |
| 2005/0170875 | A1 | 8/2005 | Snow | |
| 2006/0055112 | A1 | 3/2006 | Lean et al. | |
| 2006/0084505 | A1 | 4/2006 | Yoseloff et al. | |
| 2007/0235939 | A1 | 10/2007 | Ko | |

OTHER PUBLICATIONS

Co-pending U.S. Appl. No. 12/247,172, filed Oct. 7, 2008 entitled "Wagering Method Including a Reverse Bet."

Examiner is notified of office communication (Mail date Sep. 22, 2006) associated with co-pending U.S. Appl. No. 10/947,188 entitled "Pai-Gow Poker Game" filed Sep 21, 2004.

Examiner is notified of final office communication (Mail date Mar. 12, 2007) associated with co-pending U.S. Appl. No. 10/947,188 entitled "Pai Gow Poker Game" filed Sep. 21, 2004.

Examiner is notified of office communication (Mail date Oct. 2, 2008) associated with co-pending U.S. Appl. No. 10/947,188 entitled "Pai Gow Poker Game" filed Sep. 21, 2004.

Examiner is notified of office communication (Mail date Dec. 31, 2007) associated with co-pending U.S. Appl. No. 11/254,563 entitled "Wagering Method Including a Reverse Bet" filed Oct. 19, 2005.

Examiner is notified of a final office communication (Mail date Oct. 2, 2008) associated with co-pending U.S. Appl. No. 11/254,563 entitled "Wagering Method Including a Reverse Bet" filed Oct. 19, 2005.

Examiner is notified of office communication (Mail date Oct. 7, 2008) associated with co-pending U.S. Appl. No. 11/733,878 entitled "Wagering Method Including a Push Bet" filed Apr. 11, 2007.

Co-pending U.S. Appl. No. 11/254,563, filed Oct. 19, 2005 entitled Wagering Method Including a Reverse Bet.

Co-pending U.S. Appl. No. 11/733,878, filed Apr. 11, 2007 entitled Wagering Method Including Including a Push Bet.

Notice of Allowance dated Dec. 2, 2008 in parent U.S. Appl. No. 10/947,188, filed Sep. 21, 2004 entitled "Pai Gow Poker Game".

Interview Summary dated Jan. 29, 2009 in copending U.S. Appl. No. 11/733,878, filed Apr. 11, 2007 entitled "Wagering Method Including a Push Bet".

Interview Summary dated Jan. 29, 2009 in copending U.S. Appl. No. 11/254,563, filed Oct. 19, 2005 entitled "Wagering Method Including a Reverse Bet".

* cited by examiner

METHOD FOR ADDING QUALIFIER TO CASINO GAMES

CROSS-REFERENCE TO RELATED APPLICATIONS

This application is a continuation-in-part of co-pending U.S. patent application Ser. No. 11/254,563, filed Oct. 19, 2005, which is a continuation-in-part of U.S. patent application Ser. No. 10/947,188, filed Sep. 21, 2004, both of which are hereby incorporated by reference as if set forth herein.

BACKGROUND

1. Field of the Invention

The present invention relates to wagering games. More particularly, the present invention relates to a group of games where there is one hand or value commonly called the dealer hand and at least one, and possibly more than one, hand or value commonly called a player hand. These games may allow for a Reverse Bet that the dealer hand will beat a specific player hand, a Push Bet that the dealer hand will push with a specific player hand, or both of these wagers.

The present invention includes, but is not limited to, games where the hands are made up of tokens that are divided into two or more sub-groups. These games may include Pai Gow Poker, Pai Gow Tiles, and Thirteen-Card Poker, as well as variations of these games.

2. Background

Many wagering games are known in the prior art. Many of them involve the parties each being given a hand, which consists of a group of cards, tiles, or other gaming pieces. The present invention involves games where one of these hands is designated the dealer hand, the player/dealer hand, or the bank hand. In addition, a number of players can each have their own player hand or there can be a single player hand and more than one player can wager on each hand. Players wager on a hand and the outcome of the wager is decided by comparing the player hand to the dealer hand according to a criterion specified by the rules of the game.

In some of these games, the gaming pieces are divided up into two or more sub-groups, which are often also called hands. To avoid confusion, these sub-groups will be called sub-hands, while the larger groups will be called hands.

A banking game is a game where the casino plays an active role in the games and makes a profit by collecting losing wagers from the players. In jurisdictions where banking games are allowed, typically the casino or the establishment operating the game ("the house") funds the dealer hand. The casino pays all winning wagers, the casino collects all losing wagers, and a casino employee makes all playing decisions involving the dealer hand, typically according to a set of playing rules.

In jurisdictions where banking games are not allowed, players take turns acting as the dealer. In some other jurisdictions, one or more players may be agent(s) of the house, but other players may also take their turn to be the dealer. In all these cases, each time the game is played, a player is designated as the player/dealer. The player/dealer puts up a wager and receives a hand. All other players also make wagers and receive hands. These other players try to beat the hand of the player/dealer. If the player wins, the player is paid from the player/dealer's wager, so long as there is sufficient money to pay the player. If the player loses, the player loses his/her wager to the player/dealer, so long as the player/dealer's wager was sufficient to cover the player's wager. Usually there are some circumstances that are defined as a push. When a push occurs, no money changes hands.

There are many variations of how the player/dealer's wager is funded. Two or more parties may share in funding the wager. Two or more parties may make separate wagers, where the second or third wager only comes into play when wagers equal to the size of the first player/dealer wager have been settled.

To clarify this discussion, the dealer hand will refer to the hand that others are playing against, no matter what the source of funding. The dealer hand may be funded by the casino or a player/dealer. The other hands will be referred to as player hands.

There are many variations of how the player hands are funded. Sometimes only one player wagers on each hand. Other times more than one player can wager on a hand. Often a player can wager on more than one hand. For the purposes of this invention, the source of the funds and the makeup of the wagers are not significant.

Pai Gow Tiles (also known as simply "Pai Gow") is played with a set of tiles with markings. Each player makes a wager and then receives four tiles. In addition, another four-tile hand is given to the dealer.

The player divides the four tiles into a pair of two-tile sub-hands. The tiles in the dealer hand are also divided into a pair of two-tile sub-hands. Each two-tile player sub-hand is compared to one of the two-tile house or player/dealer sub-hands according to a ranking scheme for the two-tile combinations. The higher-ranked player sub-hand is compared to the higher-ranked dealer sub-hand, and the two lower-ranked sub-hands are compared. If both of the player's sub-hands beat both of the dealer sub-hands, the player wins an amount equal to his/her wager. If both of the dealer sub-hands are ranked higher than or equal to the player's sub-hands, then the dealer wins. If one sub-hand is ranked higher and one is ranked lower, then it is a push and no money changes hands.

Pai Gow Poker is similar to Pai Gow, but it is played with a deck of playing cards, usually with one joker. In Pai Gow Poker, each player is dealt a hand of seven cards, and the dealer is also dealt a hand of seven cards. Each party divides his cards into two sub-hands. This process is known as "setting the hand." One sub-hand, known as the "front hand" contains two cards, while the other, the "back hand," contains five cards. These sub-hands are evaluated using standard Poker rankings. The five-card sub-hand can have any Poker rank from five of a kind to a hand with no pair. The two-card sub-hand can only have a pair or be ranked by its card values. Two-card sub-hands cannot count as straights or flushes.

The only restriction on setting the hands is that the five-card sub-hand must have a higher rank than the two-card sub-hand. A player cannot, for example, put a pair in the two-card sub-hand, unless the five-card sub-hand has a hand with at least the same pair.

Chinese (13-Card) Poker is played with a standard 52-card deck. Up to four players can play. Each player receives 13 cards, face down, one at a time, in rotation. Standard Poker rankings are used. Each hand is divided into three sub-hands of three, five, and five cards. Both five-card hands must rank higher than the three-card sub-hand. The sub-hands are arranged with the three-card sub-hand designated as the front hand, the weaker of the two five-card sub-hands as the middle hand, and the strongest of the two five-card sub-hands as the back hand. The back hand must rank higher or equal to the middle hand, and the middle hand must rank higher than the front hand. Straights and flushes do not count in the front hand.

While 13-Card Poker can be played without a dealer, the present invention applies to the version of it where one hand is designated as the dealer hand. To determine the winner, each of a player's three sub-hands is compared to the corresponding dealer sub-hand. The two front hands are compared, the two middle hands are compared, and the two back hands are compared. If at least two of the player's sub-hands rank higher than the corresponding dealer sub-hands, the player wins. Otherwise, the player loses.

All of these games share a common feature when deciding who wins. When two sub-hands are compared, if they have the same value (a "copy"), this situation is treated the same as if the dealer had a higher value. Copies are treated as wins for the dealer.

In all games with at least one player hand and a dealer hand, there is a wager that a player hand will beat the dealer hand, which will be called a Normal Bet. In the traditional forms of most of these games, this is the only wager available.

Baccarat, which is traditionally played with only one player hand, has two other wagers. You can wager that the dealer hand will beat the player hand, and you can wager whether the two hands will tie.

In U.S. patent application Ser. Nos. 11/254,563 and 10/947,188, similar wagers have been added to the other games in the field of the present invention. Unlike Baccarat, these games can have more than one player hand. So for the present invention, the player who makes these wagers must select a particular hand for each wager. One wager, called a Reverse Bet, is that the dealer hand will beat a particular player hand. The other wager, called a Push Bet, is that the dealer hand will push with a particular player hand. A push is an outcome where no money would change hands on a Normal Bet.

Pushes in Pai Gow Poker and Pai Gow Tiles do not occur on ties, but rather when one dealer sub-hand wins and the other loses. In games with sub-hands, sub-hands with the same value are treated as a win for the dealer.

In Pai Gow Poker, the dealer's five-card sub-hand is compared to the player's five-card sub-hand, and the two-card sub-hands are compared. If one dealer sub-hand beats the player's sub-hand and the other loses, it is a push.

In Pai Gow Tiles, the higher-ranked of the dealer sub-hands is compared to the higher-ranked of the player sub-hands. The two lower-ranked sub-hands are compared to each other. If one dealer sub-hand beats the player's sub-hand and the other loses, it is a push.

In all these games, there is no minimum requirement for a hand value in order to be allowed to win a Reverse Bet or a Push Bet. In all games with sub-hands, there is no minimum hand value required to win a Normal Bet.

While these games have been very successful, there are some limitations to them. First, all of them pay even money. Other than a bonus for a Blackjack, the player wins exactly the amount that he wagers. Some players would like to have the chance to win a larger amount. It is more exciting to have the chance to win $20 or $1,000 on a $10 wager, than to be limited to a win of $10 or $15. The normal dealer advantage is not large enough to fund these larger payoffs. While an extra bet or side bet could be introduced for larger payoffs, it would be desirable to find a mechanism to increase the dealer advantage on the standard wager to allow larger payoffs or bonuses to be paid. Additionally, some casinos might just wish to increase the dealer advantage on the standard wager without paying any bonuses.

Another limitation of these games involves the Reverse Bet and Push Bet. Since the dealer hand typically has a built-in advantage over the player hands, a Reverse Bet would not normally pay even money. Typically a player would wager $10 to win $9. Not only could this be unpopular with players, but it makes it more complicated to settle wagers. The complexity of settling this wager makes it more difficult to calculate the exact amount, slows down the game, and can introduce errors.

Typically, the Push Bet will not pay even money. In one embodiment, it pays $13 for each $10 wagered. Again, with payoffs like this, it becomes complex to settle wagers.

It would be desirable to find a mechanism for adjusting the dealer edge for new wagers. This adjustment should be able to apply to just a specific wager or to all wagers in the game.

In recent years, a number of new games have been introduced with a "qualifier" for either the player hand or dealer hand. This qualifier is a minimum hand a designated party (either the player or the dealer) must have for the normal method of choosing winners to be used. When the designated party does not have a qualifying hand, an alternative method of deciding wagers comes into play. Depending on the game, when the minimum hand is not achieved, the payouts may be limited, certain bets will be treated as pushes, one party may automatically lose, or one party may only have the ability to push or lose, but not to win.

In all these games, the qualifier has always been a part of the game. The games were not first played without a qualifier, with a qualifier added later. The practice of adding a qualifier to games that have been played without one is not well known to those of ordinary skill in the art.

In Caribbean Stud (U.S. Pat. No. 5,725,216), a player can make two wagers called an ante and a raise. The player and the dealer each end up with a five-card Poker hand. Then it is determined if the dealer hand qualifies. If the dealer hand is at least an Ace-King, when valued as a Poker hand, the hand qualifies and the player may win or lose his two wagers. If the dealer hand is weaker than an Ace-King, then the hand does not qualify, and the player wins even money on the ante wager and the raise wager is a push.

In Three Card Poker (U.S. Pat. No. 5,685,774), the players and the dealer again can make an ante bet and a raise. They each receive a three-card hand. In this game, the dealer must have at least a Queen-high Poker hand to qualify. If the dealer qualifies, then the player may win or lose both wagers. If the dealer does not qualify, the player wins even money on the ante wager and the raise wager is a push.

In some variations of Easy Poker (U.S. Pat. No. 6,332,614) there is a minimum qualifier for the dealer hand. In Easy Poker, a player hand is compared to the better of two dealer hands. In one variation, if the dealer does not have at least a pair, the dealer automatically loses. In another version, if the dealer does not have at least a pair of sixes, the dealer can lose or push, but cannot win. Other variations have different minimum hands.

U.S. Pat. No. 6,050,569 introduces a game that is similar to Pai Gow Tiles, but played with cards. In one variation, the player must have a minimum hand to win. However, in that variation, there is no dealer hand.

U.S. Pat. No. 6,105,964 introduces a game with both a dealer hand and a qualifier hand. The player must beat the qualifier hand in order to have the option to compete against the dealer hand. There is no pre-specified minimum hand that is required to qualify.

U.S. Pat. No. 6,135,454 discloses a version of Baccarat with Jokers and where there can be more than one player hand. No Reverse Bet or Push Bet is disclosed.

U.S. Pat. No. 6,409,174 introduces a game where players play a Blackjack game and then a Poker game. In the Poker game, the player must make a minimum hand to qualify, but is not playing against a dealer hand. The player is paid based on the value of his hand.

U.S. Pat. No. 6,511,071 introduces a number of versions of Pan 9 with minimum hand requirements for the players to win. These versions do not involve sub-hands, Reverse Bets, or Push Bets.

U.S. Pat. No. 7,044,468 introduces a game where at least one player and the dealer are dealt a two-card starting hand. If the two-card hand does not meet a qualifying value, the game does not continue.

U.S. Pat. No. 7,147,227 introduces another new card game where the dealer must have a qualifying hand in some circumstances.

The prior art discloses games with a minimum hand required to win, but not for Reverse Bets and Push Bets. It also does not disclose a minimum hand for games where gaming pieces are divided into sub-hands.

SUMMARY OF THE INVENTION

The invention provides an improvement to many wagering games with at least one player hand and a dealer hand that have been played without a qualifier. These are games where the gaming pieces in a hand are divided into two or more sub-hands, and games with a Reverse Bet and/or a Push Bet. It is possible that a game with sub-hands can also have a Reverse Bet, a Push Bet, or both bets. In the improved versions of these games, at least one type of wager has a minimum hand value. When the pre-specified hand has at least that hand value, one method of settling wagers is used. A different method is used when the pre-specified hand has less than the minimum value. This minimum value is known as a qualifier.

In these games, the normal wager (Normal Bet) is a wager that a player hand will be ranked higher than the dealer hand. In addition, a wager that the dealer hand will be ranked higher than a particular player hand may be allowed (Reverse Bet), or a wager that the player's hand and dealer hand will push may be allowed (Push Bet). A qualifier may be introduced on any or all of these wagers, with the same or different qualifiers on each.

When the qualifier is satisfied, the wagers are settled in the normal way. When the qualifier is not satisfied, there are several possibilities. The hand may be deemed a push, with the bet(s) on this hand being returned to the player(s), the player may automatically win, or the dealer may automatically win.

With other options, the player and dealer hands may be compared, but the possible outcomes when the qualification is not met may be restricted. It may be that the player can win if his hand is better but only push if it is not better. It may also be that the player may lose if his hand is worse than the dealer's hand, and push otherwise.

Using the present invention, a qualifier may also be used for the Normal Bet in games where the gaming pieces in a hand are divided into two or more sub-hands.

Introducing a qualifier allows a casino to adjust the advantage for the dealer, making several desirable options practical for these games.

BRIEF DESCRIPTION OF THE DRAWING FIGURES

Figure 2:
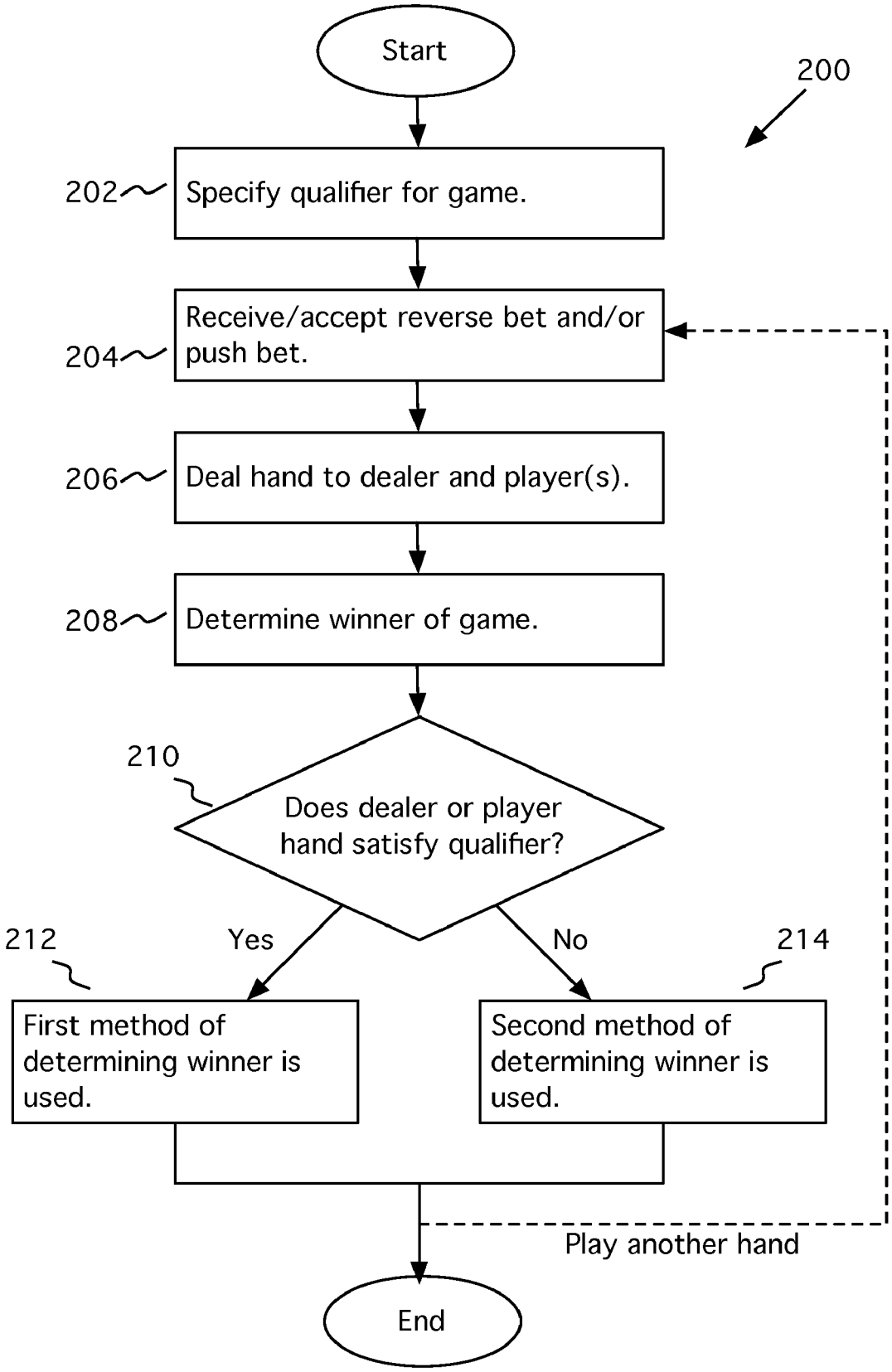

FIG. 1 illustrates an exemplary embodiment of a method for adding a qualifier to a wagering game having sub-hands in accordance with the present invention; and FIG. 2 illustrates an exemplary embodiment of a method for adding a qualifier to a wagering game having reverse bets and/or push bets in accordance with the present invention.

DETAILED DESCRIPTION

Those of ordinary skill in the art will realize that the following description of the present invention is illustrative only and not in any way limiting. Other embodiments of the invention will readily suggest themselves to such a skilled person.

For the description of a preferred embodiment, the game of Pai Gow Poker will be used where Normal Bets and Reverse Bets are allowed. Those of ordinary skill in the art will realize that the present invention can be applied to Pai Gow Tiles, 13-Card Poker, and other games where gaming pieces are divided into sub-hands. Those of ordinary skill in the art will also realize that the present invention may be applied to any game with one or more players and a dealer, where a Reverse Bet, a Push Bet, or both are allowed.

In the preferred embodiment there is a qualifier for the player's five-card hand for the Reverse Bet. For example, if the player's five-card sub-hand is not at least a King-Eight (a King-Eight is a hand with no pair, straight, or flush, and whose two highest cards are a King and an Eight), all Reverse Bets are pushes. This specified minimum is a qualifier. If the player's five-card hand has less than this value, any person who is involved in a Reverse Bet on this hand gets his money back and has no chance to win or lose.

This qualifier reduces the expectation for the player who makes the Reverse Bet. Usually, when a person makes a Reverse Bet and the player hand is very weak, the person would expect to win the Reverse Bet. By making this outcome a push when the qualifier is not met, the Reverse Bet becomes less profitable. This use of a qualifier allows other modifications in the rules and payoffs to benefit the player who makes the Reverse Bet, which may make the game easier to operate and more popular with players and casinos.

Without a qualifier, the Reverse Bet would normally pay less than even money. Typically the player would win $9 for every $10 wagered. This can be difficult to administer. Calculating the payoffs can get complicated, slowing the game down and leading to disputes and errors. With the qualifier, it is possible to pay even money, speeding the game up and simplifying the settlement of bets. With a different qualifier, it would be possible to make higher payouts or pay bonuses to those who make the Reverse Bet.

In this description of the preferred embodiment, a value of King-Eight is used as the minimum value or qualifier. This value is illustrative only and is not meant to restrict the range of possible values. Depending on how much of an advantage or disadvantage the casino might want to offer to the parties participating in a Reverse Bet and what kind of additional benefits the casino might wish to offer, this value will vary. Having the ability to adjust this value gives the game designer and the casino great flexibility in designing variations of these games to meet the needs of the casino and appeal to the players.

In the preferred embodiment, when a hand does not qualify, all wagers involving that hand are pushes. Those of ordinary skill in the art will realize that there are other ways of treating a non-qualifying hand. For example, when a player hand does not qualify, it might be possible to lose the Reverse Bet, but not to win it. Under this rule, when the player hand does not qualify, the hands would still be compared. If both player sub-hands are higher than the dealer sub-hands, the person who made the Reverse Bet would lose. Otherwise it would be a push. There could also be variations where if a hand does not qualify, one party automatically wins or loses. These options would also be available for any bet with a qualifier, not just the Reverse Bet.

In the preferred embodiment, the qualifier is a minimum value on the player hand. Those of ordinary skill in the art will realize that a qualifier could be placed on the dealer hand or on both hands. If there were a qualifier on both the player and dealer hands, the same minimum value could be applied to both hands or a different minimum value could be specified for each. These options would also be available for any bet with a qualifier, not just the Reverse Bet.

While the preferred embodiment places a qualifier on the five-card sub-hand, in other variations of Pai Gow Poker, the qualifier could be placed on the two-card sub-hand. In all games with sub-hands, the qualifier could apply to any sub-hand or there could be qualifiers for more than one sub-hand.

While the preferred embodiment places a qualifier on the Reverse Bet, those of ordinary skill in the art will realize that it would be possible to add a qualifier to the Normal Bet, the Push Bet (when one is allowed), or any combination of these bets. The same qualifier could be used for each bet or each bet could have a different qualifying value.

In one embodiment, a minimum value for the dealer hand would be specified that would apply to the Normal Bet. In a game without a qualifier, the player is paid even money on the Normal Bet when he wins. He gets his bet back and an amount equal to his bet as his winnings. With a qualifier, it would be possible to pay the player a multiple of his wager in some cases. For example, a player who wins a Normal Bet with a pair of 7's or higher as his two-card hand could win twice his wager. Another option would be to pay a bonus on the Normal Bet. A player who makes a very strong hand such as a royal flush, straight flush, or four of a kind could be paid a larger payoff. These features could make the Normal Bet in a Pai Gow Poker game or any game more popular.

Without a qualifier, a Push Bet in Pai Gow Poker would normally pay $13 for every $10 wagered. Again, settling this wager can be a problem. In some embodiments of the present invention, a qualifier may be added for the Push Bet, which would allow larger payoffs. With the right qualifier, it would be possible to pay $15 for every $10 wagered, making it a more popular wager and much easier to settle. With a more restrictive qualifier, a payment of $20 for every $10 wagered would be possible. Other embodiments would include bonuses. All these options would allow each casino to customize these games to increase their popularity and make them easier to administer.

The idea of using a qualifier could easily be applied to other games. In Pai Gow Tiles, there are 102 possible ranks for each two-tile sub-hand. A hand could be deemed as not qualifying if the dealer's weaker hand is not one of the 90 best hands, or if the player's strong hand is not one of the 60 best possible hands. Many other options are possible.

While there is no push in 13-Card Poker, a Reverse Bet with a qualifier could be used or a qualifier could apply to the normal bet.

In Blackjack, Push Bets and Reverse Bets could be introduced with qualifiers. Also a qualifier could be introduced on a Normal Bet. For example, dealer hands with a value of 17 might result in Normal Bets that can only push or lose. To compensate the player, the payoff on a Blackjack might be increased to 3 to 1. Also, dealer hands with a value of 18 or less might not qualify, with Normal Bets either losing or pushing. All winning Normal Bets might be paid off at 2 to 1.

While the preferred embodiment uses a hand value as the qualifier, those of ordinary skill in the art will realize that many other mechanisms could be used. A hand might qualify if it contains one or more predetermined sets of tokens or it might not qualify if it does not contain one more predetermined sets of tokens. For example, a Blackjack hand with two cards of 6 or lower might not qualify. In Pai Gow Poker, a seven-card hand without an ace or a pair might not qualify. In Pai Gow Tiles, any four-tile hand that includes a tile with 4 spots, one with 6 spots, and one with 7 spots might not qualify, no matter what the fourth tile was. There could even be cases where not only the tokens in a hand, but the sequence in which the tokens appear might determine whether or not a hand qualifies.

FIG. 1 illustrates an exemplary embodiment of a method 100 for adding a qualifier to a wagering game having sub-hands in accordance with the present invention. At step 102, a qualifier is specified for the game. In a preferred embodiment, this qualifier is a minimum value for a sub-hand. At step 104, one or more bets/wagers are received/accepted. These bets may include, but are not limited to, Normal Bets, Reverse Bets, and Push Bets. At step 106, a hand of game pieces is dealt to the dealer and to each player. At step 108, the game pieces in each hand are divided into multiple sub-hands. In a preferred embodiment, each hand is divided into two sub-hands.

At step 110, the winner of the game is determined between the dealer and each player based on the value of the dealer's hand and the value of each player's hand. It is determined at step 112 whether or not the qualifier is satisfied. In one embodiment, it is determined whether or not a predetermined sub-hand of the dealer's sub-hands meets the requirements of the qualifier. In another embodiment, it is determined whether or not a predetermined sub-hand of the player's sub-hands meets the requirements of the qualifier. In yet another embodiment, it may be determined whether or not a predetermined sub-hand of both the dealer's and the player's sub-hands meet the requirements of the qualifier. In a preferred embodiment, satisfying the qualifier is achieved by the predetermined sub-hand having a value greater than or equal to a qualifying minimum value. However, it is contemplated that various criteria may be used. If the qualifier is satisfied, then a first method of determining the winner of the game is used at step 114. If the qualifier is not satisfied, then a second method of determining the winner, different from the first method, is used at step 116. Once a winner is determined, the bets may be settled and the process may come to an end. Optionally, instead of the process ending, it may repeat at step 104 so that another hand may be played using the same qualifier for the game.

FIG. 2 illustrates an exemplary embodiment of a method 200 for adding a qualifier to a wagering game having reverse bets and/or push bets in accordance with the present invention. At step 202, a qualifier is specified for the game. In a preferred embodiment, this qualifier is a minimum value for a hand. At step 204, one or more bets/wagers are received/accepted, including either a Reverse Bet or a Push Bet. At step 206, a hand of game pieces is dealt to the dealer and to each player.

At step 208, the winner of the game is determined between the dealer and each player based on the value of the dealer's hand and the value of each player's hand. It is determined at step 210 whether or not the qualifier is satisfied. In one embodiment, it is determined whether or not the dealer's hand meets the requirements of the qualifier. In another embodiment, it is determined whether or not the player's hand meets the requirements of the qualifier. In yet another embodiment, it may be determined whether or not both the dealer's and the player's hands meet the requirements of the qualifier. In a preferred embodiment, satisfying the qualifier is achieved by the predetermined dealer and/or player hand having a value greater than or equal to a qualifying minimum value. However, it is contemplated that various criteria may be used. If the qualifier is satisfied, then a first method of determining the winner of the game is used at step 212. If the qualifier is not satisfied, then a second method of determining the winner, different from the first method, is used at step 214. Once a winner is determined, the bets may be settled and the process may come to an end. Optionally, instead of the process ending, it may repeat at step 204 so that another hand may be played using the same qualifier for the game.

Although the invention has been illustrated and described in detail herein, it is to be understood that various changes and modifications may be made therein without departing from the spirit and scope of the invention as defined in the appended claims.

What is claimed is:

1. A method of playing a game with a dealer and one or more players comprising:

providing a set of game pieces;

accepting one or more wagers that are settled by comparing a dealer hand to a specific player hand;

specifying a pre-determined minimum hand value;

dealing a hand of game pieces to the dealer;

dealing a hand of game pieces to each of the one or more players;

dividing the game pieces in the dealer hand into two or more sub-hands;

dividing the game pieces in each of the one or more players hands into two or more sub-hands;

specifying a pre-determined sub-hand for comparison to the predetermined minimum hand value;

determining a winner of each of the one or more wagers, wherein a first method of determining the winner is used when the predetermined sub-hand has a value greater than or equal to the pre-determined minimum hand value and a second method of determining the winner is used the predetermined subhand has a value less than the predetermined minimum hand value, the first method and the second method being different; and paying the winner of each of the one or more wagers.

2. The method of claim 1, wherein the pre-determined sub-hand is one of the dealer's sub-hands.

3. The method of claim 2, wherein the one or more wagers includes a wager that a specific player hand of the one or more players will beat the dealer hand.

4. The method of claim 2, wherein the one or more wagers includes a wager that the dealer hand will beat a specific player hand of the at least one players.

5. The method of claim 2, wherein:

a normal wager that a specific player hand of the one or more players will beat the dealer hand is allowed in the game;

the normal wager may result in a push where no money exchanges hands; and the one or more wagers includes a wager that the hand of the game will have a result where the push would occur under the normal wager.

6. The method of claim 1, wherein the pre-determined sub-hand is one of the one or more players sub-hands.

7. The method of claim 6, wherein the one or more wagers includes a wager that a specific player hand of the one or more players will beat the dealer hand.

8. The method of claim 6, wherein the one or more wagers includes a wager that the dealer hand will beat a specific player hand of the one or more players.

9. The method of claim 6, wherein:

a normal wager that a specific player hand of the one or more players will beat the dealer hand is allowed in the game;

the normal wager may result in a push where no money exchanges hands; and the one or more wagers includes a wager that the hand of the game will have a result where the push would occur under the normal wager.

10. The method of claim 1, wherein the game is Pai Gow Poker.

11. The method of claim 10, wherein the pre-determined sub-hand is one of the dealer's sub-hands.

12. The method of claim 11, wherein the one or more wagers includes a wager that a specific player hand of the one or more players will beat the dealer hand.

13. The method of claim 12, wherein the one or more wagers includes a wager that a specific player hand of the one or more players will beat the dealer hand.

14. The method of claim 12, wherein the one or more wagers includes a wager that the dealer hand will beat a specific player hand of the one or more players.

15. The method of claim 12, wherein:

a normal wager that a specific player hand of the one or more players will beat the dealer hand is allowed in the game;

the normal wager may result in a push where no money exchanges hands; and the one or more wagers includes a wager that the hand of the game will have a result where the push would occur under the normal wager.

16. The method of claim 11, wherein the one or more wagers includes a wager that the dealer hand will beat a specific player hand of the one or more players.

17. The method of claim 11, wherein:

a normal wager that a specific player hand of the one or more players will beat the dealer hand is allowed in the game;

the normal wager may result in a push where no money exchanges hands; and the one or more wagers includes a wager that the hand of the game will have a result where the push would occur under the normal wager.

18. The method of claim 10, wherein the pre-determined sub-hand is one of the one or more players sub-hands.

19. The method of claim 1, wherein the game is Pai Gow Tiles.

20. The method of claim 19, wherein the pre-determined sub-hand is one of the dealer's sub-hands.

21. The method of claim 20, wherein the one or more wagers includes a wager that a specific player hand of the one or more players will beat the dealer hand.

22. The method of claim 20, wherein the one or more wagers includes a wager that the dealer hand will beat a specific player hand of the one or more players.

23. The method of claim 20, wherein:

a normal wager that a specific player hand of the one or more players will beat the dealer hand is allowed in the game;

the normal wager may result in a push where no money exchanges hands; and the one or more wagers includes a wager that the hand of the game will have a result where the push would occur under the normal wager.

24. The method of claim 19, wherein the pre-determined sub-hand is one of the one or more players sub-hands.

25. The method of claim 23, wherein the one or more wagers includes a wager that a specific player hand of the one or more players will beat the dealer hand.

26. The method of claim 24, wherein the one or more wagers includes a wager that the dealer hand will beat a specific player hand of the one or more players.

27. The method of claim 24, wherein:

a normal wager that a specific player hand of the one or more players will beat the dealer hand is allowed in the game;

the normal wager may result in a push where no money exchanges hands; and the one or more wagers includes a wager that the hand of the game will have a result where the push would occur under the normal wager.

28. A method of playing a Blackjack game with a dealer and one or more players comprising:

providing a set of game pieces;

accepting one or more wagers that are settled by comparing a dealer hand to a specific player hand;

specifying a pre-determined minimum hand value;

dealing a hand of game pieces to the dealer;

dealing a hand of game pieces to each of the one or more players;

specifying at least one pre-determined hand for comparison to the predetermined minimum hand value; and determining a winner of each of the one or more wagers, wherein a first method of determining the winner is used when the at least one predetermined hand has a value greater than or equal to the pre-determined minimum hand value and a second method of determining the winner is used when the at least one predetermined hand has a value less than the predetermined minimum hand value, the first method and the second method being different; and paying the winner of each of the one or more wagers.

29. The method of claim 28, wherein the at least one pre-determined hand is the dealer's hand.

30. The method of claim 29, wherein the one or more wagers includes a wager that a specific player hand of the one or more players will beat the dealer hand.

31. The method of claim 30, wherein the one or more wagers includes a wager that the dealer hand will beat a specific player hand of the one or more players.

32. The method of claim 30, wherein:

a normal wager that a specific player hand of the one or more players will beat the dealer hand is allowed for a hand of the game;

the normal wager may result in a push where no money exchanges hands; and the one or more wagers includes a wager that the hand of the game will have a result where the push would occur under the normal wager.

33. The method of claim 28, wherein the at least one pre-determined hand is one of the one or more players hands.

34. The method of claim 33, wherein the one or more wagers includes a wager that a specific player hand of the one or more players will beat the dealer hand.

35. The method of claim 33, wherein the one or more wagers includes a wager that the dealer hand will beat a specific player hand of the one or more players.

36. The method of claim 33, wherein:

a normal wager that a specific player hand of the one or more players will beat the dealer hand is allowed for a hand of the game;

the normal wager may result in a push where no money exchanges hands; and the one or more wagers includes a wager that the hand of the game will have a result where the push would occur under the normal wager.

37. A method of playing a game with a dealer and one or more players comprising:

providing a set of game pieces;

accepting a wager that a dealer hand will beat a specific player hand;

specifying a pre-determined minimum hand value;

dealing a hand of game pieces to the dealer;

dealing a hand of game pieces to the one or more players;

specifying at least one pre-determined hand for comparison to the predetermined minimum hand value;

determining a winner of the wager, wherein a first method of determining sai the d winner is used when the at least one predetermined hand has a value greater than or equal to the pre-determined minimum hand value and a second method of determining the winner is used when the at least one predetermined hand has a value less than the predetermined minimum hand value, the first method and the second method being different; and paying the winner of each of the one or more wagers.

38. The method of claim 37, wherein the at least one pre-determined hand is the dealer's hand.

39. The method of claim 37, wherein the at least one pre-determined hand is one of the one or more players hands.

40. A method of playing a game with a dealer and one or more players comprising:

providing a set of game pieces;

accepting a wager that a dealer hand will tie a specific player hand;

specifying a pre-determined minimum hand value;

dealing a hand of game pieces to the dealer;

dealing a hand of game pieces to the one or more players;

specifying at least one pre-determined hand for comparison to the predetermined minimum hand value;

determining a winner of the wager, wherein a first method of determining the winner is used when the at least one predetermined hand has a value greater than or equal to the pre-determined minimum hand value and a second method of determining the winner is used when the at least one predetermined hand has a value less than the predetermined minimum hand value, the first method and the second method being different; and paying the winner of each of the one or more wagers.

41. The method of claim 40, wherein the pre-determined hand is the dealer's hand.

42. The method of claim 40, wherein the pre-determined hand is one of the one or more players hands.

43. A method of playing a game with a dealer and one or more players comprising:

providing a set of game pieces;

accepting one or more wagers, wherein a normal wager that a specific player hand of the one or more players will beat the dealer hand is allowed for a hand of the game, the normal wager may result in a push where no money exchanges hands, and the one or more wagers includes a wager that the hand of the game will have a result where the push would occur under the normal wager;

specifying a pre-determined minimum hand value;

dealing a hand of game pieces to the dealer;

dealing a hand of game pieces to the one or more players;

specifying at least one pre-determined hand for comparison to the predetermined minimum hand value;

determining a winner of the one or more wagers, wherein a first method of determining the winner is used when the at least one predetermined hand has a value greater than or equal to the pre-determined minimum hand value and a second method of determining the winner is used when the at least one predetermined hand has a value less than the predetermined minimum hand value, the first method and the second method being different; and paying the winner of each of the one or more wagers.

44. The method of claim 43, wherein the pre-determined hand is the dealer's hand.

45. The method of claim 43, wherein the pre-determined hand is one of the one or more players hands.

46. A method of playing a wagering game with a Dealer Hand and one or more players hands consisting of gaming tokens comprising:

providing a set of game tokens;

accepting one or more wagers that are settled by comparing a dealer hand to a specific player hand;

specifying one or more pre-determined sets of tokens;

dealing a hand of gaming tokens to the dealer;

dealing a hand of gaming tokens to the one or more players;

specifying a pre-determined hand for comparison to the predetermined set of tokens;

determining a winner of the one or more wagers, wherein a first method of determining the winner is used when the predetermined hand contains at least one of the predetermined sets of tokens and a second method of determining the winner is used when the predetermined hand does not contain at least one of the predetermined sets of tokens the first method and the second method being different; and paying the winner of each of the one or more wagers.

47. The method of claim 46, wherein the pre-determined hand is the dealer's hand.

48. The method of claim 46, wherein the pre-determined hand is one of the one or more players hands.

49. The method of claim 46, wherein the one or more wagers includes a wager that the dealer's hand will beat a specific player hand.

50. The method of claim 46, wherein:

a normal wager that a specific player hand of the one or more players will beat the dealer hand is allowed for a hand of the wagering game;

the normal wager may result in a push where no money exchanges hands; and the one or more wagers includes a wager that the hand of the game will have a result where the push would occur under the normal wager.

51. A method of playing a wagering game with a dealer and one or more players comprising:

providing a set of game tokens;

accepting one or more wagers that are settled by comparing a dealer hand to a specific player hand;

specifying one or more pre-determined subsets of tokens;

dealing a hand of gaming tokens to the dealer;

dealing a hand of gaming tokens to the one or more players;

dividing the gaming tokens in the dealer hand into two or more sub-hands;

dividing the gaming tokens in each of the one or more players hands into two or more sub-hands;

specifying a pre-determined sub-hand for comparison to the predetermined subset of tokens; and determining a winner of the one or more wagers, wherein a first method of determining the winner is used when the predetermined sub-hand contains at least one of the predetermined subsets of tokens and a second method of determining the winner is used when the predetermined sub-hand does not contain at least one of the predetermined subsets of tokens, the first method and the second method being different; and paying the winner of each of the one or more wagers.

52. The method of claim 51, wherein the pre-determined sub-hand is one of the dealer's sub-hands.

53. The method of claim 51, wherein the pre-determined sub-hand is one of the one or more players sub-hands.

54. The method of claim 51, wherein the wagering game is Pai Gow Poker.

55. The method of claim 51, wherein the wagering game is Pai Gow Tiles.

56. The method of claim 51, wherein the one or more wagers includes a wager that the dealer hand will beat a specific player hand.

57. The method of claim 51, wherein:

a normal wager that a specific player hand of the one or more players will beat the dealer hand is allowed in the game;

the normal wager may result in a push where no money exchanges hands; and the one or more wagers includes a wager that the hand of the game will have a result where the push would occur under the normal wager.

* * * * *